US006196854B1

(12) United States Patent
Hand

(10) Patent No.: US 6,196,854 B1
(45) Date of Patent: Mar. 6, 2001

(54) ELECTRICAL CONNECTOR

(75) Inventor: Edward Hand, Stalybridge (GB)

(73) Assignee: Hawke Cable Glands Limited, West Midlands (GB)

( * ) Notice: Subject to any disclaimer, the term of this patent is extended or adjusted under 35 U.S.C. 154(b) by 0 days.

(21) Appl. No.: 09/264,324

(22) Filed: Mar. 8, 1999

(30) Foreign Application Priority Data

Mar. 14, 1998 (GB) ..... 9805366

(51) Int. Cl.[7] ..... H01R 13/44
(52) U.S. Cl. ..... 439/138
(58) Field of Search ..... 439/138, 201, 439/589, 281, 559, 137, 139

(56) References Cited

U.S. PATENT DOCUMENTS 3,892,456 * 7/1975 Westmoreland ..... 439/137
5,171,158 12/1992 Cairns .
5,716,224 * 2/1998 Masuda et al. ..... 439/138
5,899,765 * 5/1999 Niekrasz et al. ..... 439/201
6,017,227 * 1/2000 Cairns et al. ..... 439/138

FOREIGN PATENT DOCUMENTS 0 048 601A2 3/1982 (EP) .
0 124 987A2 11/1984 (EP) .
0 251 655A1 1/1988 (EP) .
2 264 201A 8/1993 (GB) .

* cited by examiner

*Primary Examiner*—Brian Sircus
*Assistant Examiner*—Chandrika Prasad
(74) *Attorney, Agent, or Firm*—Frishauf, Holtz, Goodman, Langer & Chick, P.C.

(57) ABSTRACT

The female part of an underwater electrical connector has inner and outer chambers containing non-conductive fluid. Each chamber has an opening sealed by a respective spring loaded ball in the unmated condition of the connector and by a contact pin of the male part in the mated condition of the connector. The balls are displaced transversely to the direction of movement of the contact pin to engage the contact socket and automatically re-seal the openings when the contact pin is withdrawn.

19 Claims, 3 Drawing Sheets

ELECTRICAL CONNECTOR

BACKGROUND OF THE INVENTION

This invention relates to electrical connectors and in particular, though not exclusively, to underwater electrical connectors designed for releasable mating engagement.

Known underwater electrical connectors commonly comprise a male part having at least one contact pin and a female part having at least one contact socket for reception of the contact pin when the male and female parts are brought together.

Usually, the engagement of the contacts is effected in a non-conductive fluid such as oil which isolates the contacts from the surrounding water. Typically, the contact socket is arranged in a chamber containing the fluid and the contact pin extends through and seals an opening into the chamber to prevent escape of the fluid from the chamber and/or penetration of the surrounding water into the chamber in the mated condition of the connector.

In one arrangement, the opening is self-closing to seal the chamber in the unmated condition of the connector. A relatively low force is sufficient to insert the contact pin and engage the contact socket with the result that there is no tendency for the connector to de-mate. However, insertion of the contact pin distorts the opening with the result that sealing efficiency may be reduced on removal of the contact pin. Sealing efficiency may also be adversely affected with temperature, pressure changes in the surrounding water.

In another arrangement, the opening is closed to seal the chamber in the unmated condition of the connector by a slidable, spring loaded piston that is pushed back when the contact pin is inserted to engage the contact socket. A relatively high force is required to overcome the biasing of the shuttle pin when the contact pin is inserted to engage the contact socket with the result that there is a tendency for the connector to de-mate. Furthermore, although there is less distortion of the opening, wear and abrasion from sliding movement of the shuttle pin can result in a reduction in sealing efficiency.

SUMMARY OF THE INVENTION

The present invention is intended to provide an electrical connector of simple construction in which the problems and disadvantages aforementioned are mitigated.

According to the present invention we provide an electrical connector comprising first and second parts, a contact of the first part extending through an opening in the second part when the first and second parts are brought together to engage a contact of the second part in a mated condition of the connector, the opening being closed in an unmated condition of the connector by a resiliently biased member arranged so that, when the first and second parts are brought together, the member is engaged by the contact of the first part during insertion thereof through the opening and is displaced transversely with respect to the direction of movement of the first part to engage the contact of the second part, and non-conductive fluid within the second part.

By this invention, the resilient biasing of the member acts transverse to the direction of movement of the contact pin in the mated condition of the connector. As a result, there is no tendency for the connector to de-mate.

Preferably, the member comprises a ball engageable with a part-spherical seating to close the opening in the unmated condition of the connector. In this way, the opening is not subject to wear and abrasion from displacement of the ball towards and away from the seating.

Advantageously, the ball is biased to close the opening by a spring, preferably a torsion spring. As a result, the ball automatically closes the opening when the contact pin is withdrawn in the unmated condition of the connector.

In a preferred arrangement, the opening is provided in a chamber containing the non-conductive fluid and is closed in the mated condition of the connector by the contact pin to prevent escape of the fluid.

Preferably, two chambers are provided each containing non-conductive fluid and having axially aligned openings closed by respective resiliently biased members that are displaced transversely by the contact pin when the first and second parts are brought together.

The invention will now be described in more detail, by way of example only, with reference to the accompanying drawings.

DETAILED DESCRIPTION OF THE EXEMPLARY EMBODIMENT

Figure 1:
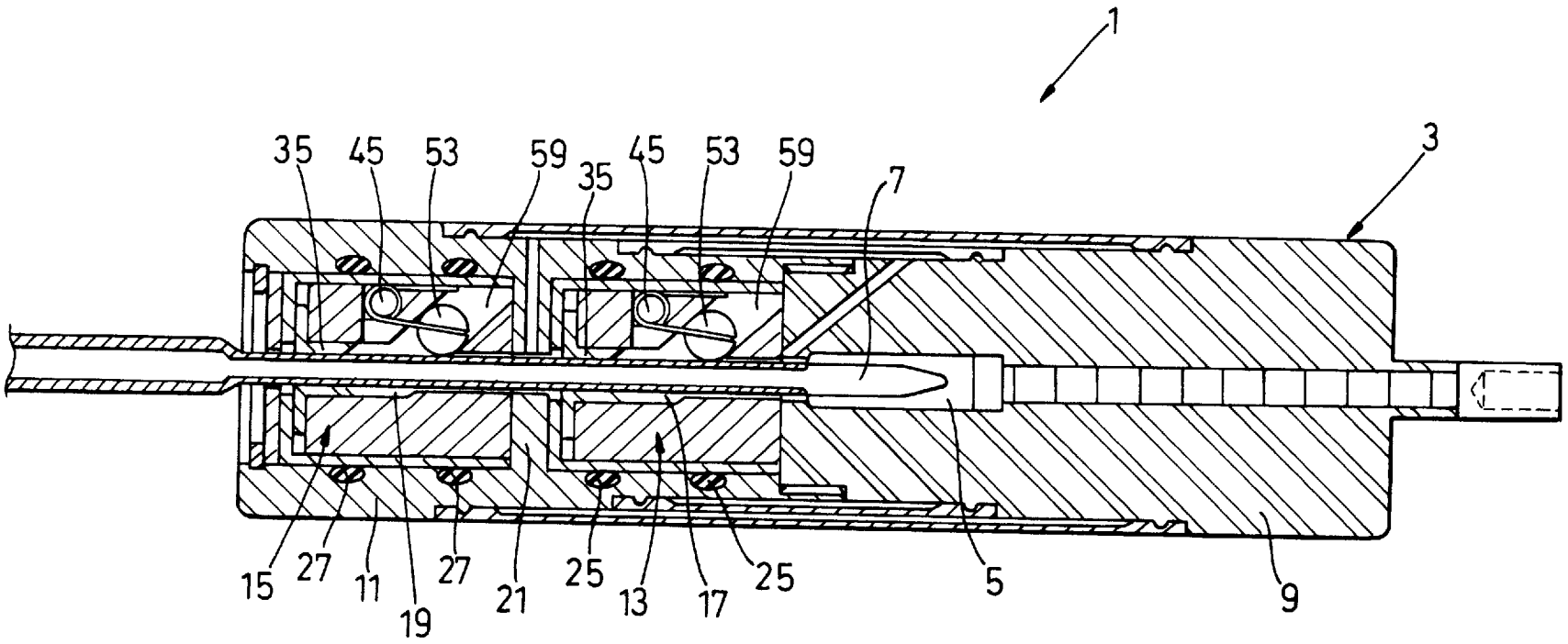
FIG. 1 is a longitudinal section showing an electrical connector embodying the invention in the mated condition.

The electrical connector 1 comprises a female part 3 having a contact socket 5 for reception of a contact pin 7 of a male part (not shown) in the mated condition of the connector 1 shown in FIG. 1.

The connector 1 may have more than one pair of mating contacts 5,7 with any suitable means (not shown) for ensuring each pair of mating contacts 5,7 is correctly aligned when the two parts of the connector 1 are brought together.

Figure 2:
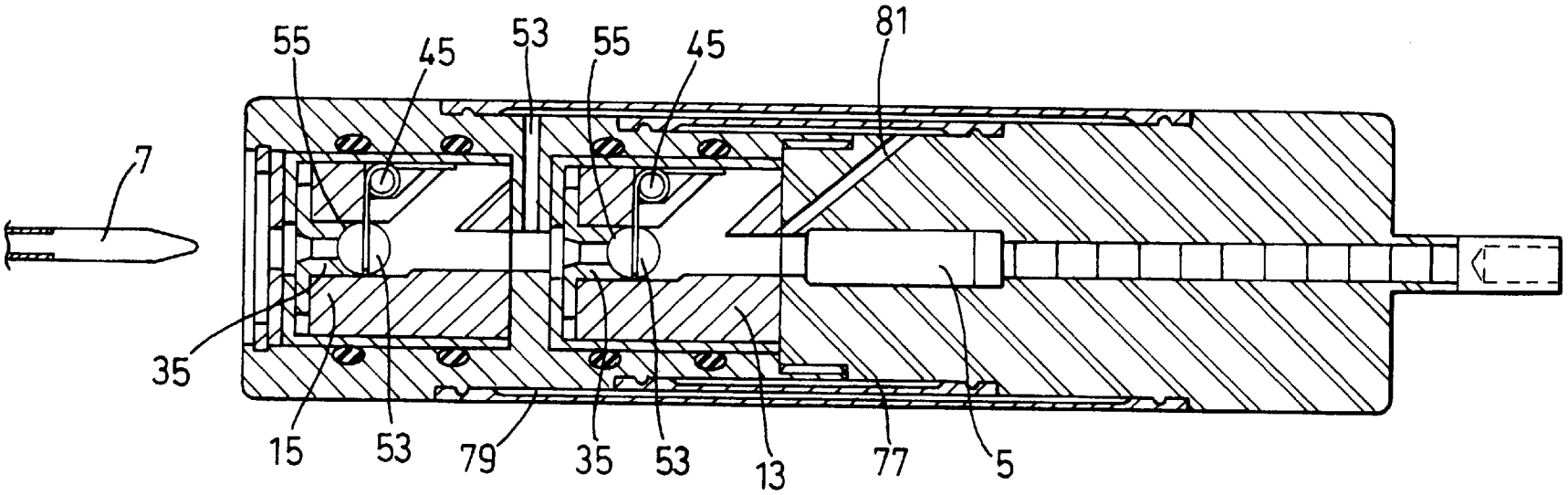
FIG. 2 is a longitudinal section showing the electrical connector of FIG. 1 in the unmated condition.
Figure 3:
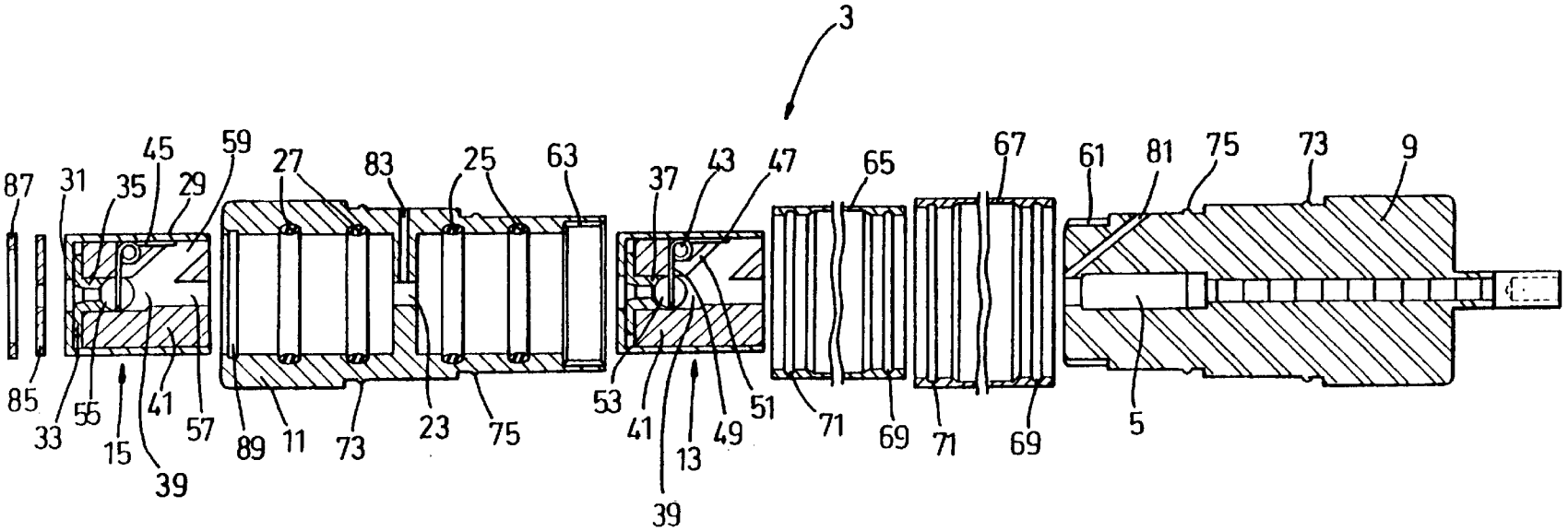
FIG. 3 is an exploded longitudinal section showing the component parts of the female part of the connector shown in FIGS. 1 and 2.

The contact socket 5 is provided in a rear section 9 of the female part 3 and a front section 11 houses a pair of seal units 13,15 for retaining a dielectric medium within inner and outer chambers 17,19 in the unmated condition of the connector 1 shown in FIG. 2.

The seal units 13,15 are slidably received within the front section 11 on opposite sides of a partition wall 21 having a central opening 23 connecting the seal units 13,15 and are sealed within the front section 11 by respective pairs of O-rings 25,27.

Each seal unit 13,15 includes an outer sleeve 29 with an internal flange 31 at one end providing an abutment for an external collar 33 of a bush 35 received in the entry end 37 of a through bore 39 in an insert 41 slidably received in the outer sleeve 29.

Each seal unit 13,15 further includes a torsion spring 43 located in a recess 45 in the outer surface of the insert 41. The spring 43 has a leg 47 at one end secured between the insert 41 and the outer sleeve 29 to prevent rotation of the spring 43 in the recess 45.

A leg 49 at the other end of the spring 43 extends through a slot 51 in the insert 41 and carries a ball 53 of metal or plastics. The ball 53 is biased by the spring 43 to engage a part-spherical seating 55 at the end of the bush 35 in the unmated condition of the connector 1 shown in FIG. 2. The ball 53 may be biased by any other suitable means.

An exit end 57 of the through bore 39 is of reduced cross-section smaller than the diameter of the ball 53 and the insert 41 has a transverse bore 59 of similar cross-section to the entry end 37 of the through bore 39. The ball 55 is displaced into the transverse bore 59 by the contact pin 7 in the mated condition of the connector 1 shown in FIG. 1.

The front end of the rear section 9 of the female part 3 is a push fit in the rear end of the front section 11 with engagement of respective axial formations 61,63 to prevent relative rotation therebetween.

The two sections 9,11 are axially secured together so that the contact socket 5 is axially aligned with the through bores 39 in the seal units 13,15 and with the opening 23 in the partition wall 21.

Two sleeves 65,67 with internal grooves 69,71 at opposite ends are engageable with external annular ribs 73,75 on the front and rear sections of the female part 3 to form concentric annular pressure balancing chambers 77,79.

The annular chamber 77 communicates with the inner chamber 13 via an angled bore 81 in the rear section 9 of the female part 3 and the annular chamber 79 communicates with the outer chamber 15 via a radial bore 83 in the front section 11.

The seal unit 13 of the inner chamber 17 is located and retained in the front section 9 when the front and rear sections 9,11 are connected together. The seal unit 15 of the outer chamber 19 is located and retained in the front section 9 by a washer 85 secured by a circlip 87 received in an internal annular groove 89.

In the unmated condition of the connector 1 shown in FIG. 2, the ball 53 of each seal unit 13,15 co-operates with the seating 55 of the bush 35 under the biasing of the torsion spring 43 to seal the chambers 17,19.

In the mated condition of the connector 1 shown in FIG. 1, the ball 53 of each seal unit 13,15 is displaced by the contact pin 7 against the biasing of the torsion spring 43 into the transverse bore 59 and the contact pin 7 extends through the bush 35 of each seal unit 13,15 to seal the chambers 17,19.

In this way, dielectric medium is prevented from escaping and water is prevented from entering the chambers 17,19 in both the mated and unmated conditions of the connector 1.

When the male and female parts of the connector 1 are brought together to make an electrical connection, the contact pin 7 penetrates and seals the outer chamber 19 followed by the inner chamber 17 before engaging the contact socket 5.

The reverse sequence occurs when the male and female parts of the connector 1 are taken apart with each chamber 17,19 being automatically re-sealed by engagement of the ball 53 with the seating 55 of the bush 35 under the biasing of the spring 43 when the contact pin 7 is withdrawn through the bush 35.

As will be appreciated, by displacing the ball 53 of each seal unit 13,15 transversely with respect to the direction of movement of the contact pin 7, there is no axial spring force acting on the contact pin 7 in the mated condition. As a result, insertion of the contact pin 7 is facilitated and there is no tendency for the connector to de-mate.

Furthermore, such transverse displacement avoids the problems of wear and abrasion caused by axial displacement of a shuttle pin in the prior art connectors and enables the overall length of the connector to be reduced.

In the above described connector 1, engagement of the contact pin 7 with the contact socket 5 is protected by a pair of seal units. It will be appreciated however that the number of seal units may be increased or decreased to suit any particular requirements.

I claim:

1. An electrical connector comprising first and second parts, a contact of said first part extending through an opening in said second part when said first and second parts are brought together to engage a contact of said second part in a mated condition of the electrical connector, said second part having a chamber containing non-conductive fluid, said opening communicating with said chamber and being closed in an un-mated condition of the electrical connector by a resiliently biased member arranged so that, when said first and second Darts are brought together, said resiliently biased member is engaged by said contact of said first part during insertion thereof through said opening and is displaced transversely with respect to the direction of movement of said first part to engage said contact of said second part, whereby said opening is closed in the mated condition of the connector by said contact of said first part and the mated condition is substantially unaffected by the biasing, wherein said resiliently biased member comprises a ball resiliently biased to close said opening in the un-mated condition of the connector.

2. An electrical connector according to claim 1 wherein said ball is biased to close said opening by a spring.

3. An electrical connector according to claim 2 wherein said spring is a torsion spring.

4. An electrical connector according to claim 1 wherein said opening is provided with a part-spherical seating engaged by said ball in the unmated condition of the electrical connector.

5. An electrical connector according to claim 1 wherein said contact of said first part comprises a pin and said contact of said second part comprises a socket.

6. An electrical connector according to claim 5 wherein said ball is displaced by insertion of said pin through said opening to engage said socket in the mated condition of the electrical connector.

7. An electrical connector according to claim 1 wherein a plurality of axially aligned openings are provided for insertion of said contact of the first part with each opening being closed by a respective ball in the unmated condition of the electrical connector.

8. An electrical connector according to claim 7 wherein said contact of said second part is arranged inwardly of the innermost opening.

9. An electrical connector comprising a first part having a male contact, a second part having a female contact engaged by said male contact when said first and second parts are brought together in a mated condition, non-conductive fluid in a chamber containing said female contact, said chamber having an entry opening aligned with said female contact for insertion of said male contact in an axial direction, and a stopper biased to close said entry opening in an un-mated condition of the connector, said stopper being displaced generally sideways with respect to said axial direction of insertion of said male contact whereby said mated condition is unaffected by said biasing of said stopper and said entry opening is closed by said male contact, and a through bore fluidly coupled to said entry opening and having a cross-section for placement of the stopper in an un-mated condition, the through bore including an exit end fluidly coupled thereto having a cross-section smaller than that of the through bore, and a transverse bore fluidly coupled thereto, wherein when the first and second parts are brought together in a mated condition, said stopper is engaged by said contact of said first part and is displaced into said transverse bore.

10. An electrical connector according to claim 9 wherein said stopper is mounted for pivotal movement by a torsion spring biasing said stopper to a first position closing said entry opening, and said stopper is moveable to a second position by engagement with said male contact.

11. An electrical connector according to claim 10 wherein said male contact has a distal end engageable with said female contact in said mated condition, and, spaced from said distal end, said male contact blocks said stopper in said mated condition to prevent said stopper returning to said first position.

12. An electrical connector according to claim 11 wherein said non-conductive fluid is contained in a plurality of chambers having co-axial entry openings for insertion of said male contact, each entry opening being closed by a stopper in said un-mated condition, and said male contact sequentially engaging and moving said stoppers during insertion to engage said female contact.

13. An electrical connector according to claim 12 wherein each chamber is connected to pressure balancing means.

14. An underwater electrical connector comprising a first part having a male contact, a second part having a female contact engaged by said male contact when said first and second parts are brought together in a mated condition, said female contact being arranged in a chamber containing non-conductive fluid, said chamber having an entry opening for insertion of said male contact, said entry opening being aligned with said female contact to define an insertion axis and being closed by a stopper to seal said chamber in an un-mated condition, said stopper being biased by a spring to close said entry opening and being movable to one side of said insertion axis by engagement with said male contact during insertion of said male contact to engage said female contact such that said biasing does not act to de-mate said male and female contacts in the mated condition in which said opening is closed by said male contact to seal said chamber, and a through bore fluidly coupled to said entry opening and having a cross-section for placement of the stopper in an un-mated condition, the through bore including an exit end fluidly coupled thereto having a cross-section smaller than that of the through bore, and a transverse bore fluidly coupled thereto, wherein when the first and second parts are brought together in a mated condition, said stopper is engaged by said contact of said first part and is displaced into said transverse bore.

15. An electrical connector comprising first and second parts, a contact of said first part extending through an opening in said second part when said first and second parts are brought together to engage a contact of said second part in a mated condition of the electrical connector, said second part having a chamber containing non-conductive fluid, said opening communicating with said chamber and being closed in an un-mated condition of the electrical connector by a resiliently biased member arranged so that, when said first and second parts are brought together, said resiliently biased member is engaged by said contact of said first part during insertion thereof through said opening and is displaced transversely with respect to the direction of movement of said first part to engage said contact of said second part whereby said opening is closed in the mated condition of the connector by said contact of said first part and the mated condition is substantially unaffected by the biasing, and a through bore fluidly coupled to said opening and having a cross-section for placement of the resiliently biased member in an un-mated condition, the through bore including an exit end fluidly coupled thereto having a cross-section smaller than that of the through bore, and a transverse bore fluidly coupled thereto, wherein when the first and second parts are brought together in a mated condition, said resiliently biased member is engaged by said contact of said first part and is displaced into said transverse bore.

16. An electrical connector according to claim 1, wherein the resiliently biased member is displaced both in the direction of movement of the first part and transverse with respect to the direction of movement of the first part.

17. An electrical connector according to claim 9, wherein the stopper is displaced both in the direction of movement of the first part and transverse with respect to the direction of movement of the first part.

18. An underwater electrical connector according to claim 14, wherein the stopper is displaced both in the direction of movement of the first part and transverse with respect to the direction of movement of the first part.

19. An electrical connector according to claim 1, wherein the electrical connector is an underwater connector.

* * * * *